United States Patent [19]

Romagnoli

[11] 4,094,127

[45] June 13, 1978

[54] APPARATUS FOR FORMING, FILLING AND CLOSING PLASTICS TRAYS

[76] Inventor: Andrea Romagnoli, Via Madonna dei Boschi, 18, S. Lazzaro di Savena (Prov. of Bologna), Italy

[21] Appl. No.: 745,939

[22] Filed: Nov. 29, 1976

[51] Int. Cl.[2] ..... B65B 41/18; B65B 47/02

[52] U.S. Cl. ..... 53/51; 53/141; 53/184 R

[58] Field of Search ..... 53/51, 141, 184 R; 72/160, 161; 156/229, 494, 495; 226/28, 29, 30; 425/66

[56] References Cited

U.S. PATENT DOCUMENTS

| | | | |
|---|---|---|---|
| 2,275,095 | 3/1942 | Thaden | 72/160 |
| 3,351,697 | 11/1967 | Hufnagel et al. | 264/288 |
| 3,529,396 | 9/1970 | Young et al. | 53/184 X |
| 3,589,095 | 6/1971 | James et al. | 53/51 |
| 3,733,773 | 5/1973 | Hamilton | 53/184 |
| 3,762,125 | 10/1973 | Prena | 53/51 |
| 3,808,772 | 5/1974 | Turtschan | 53/184 X |

*Primary Examiner*—Robert Louis Spruill
*Attorney, Agent, or Firm*—Guido Modiano; Albert Josif

[57] ABSTRACT

Apparatus for manufacturing thermoformed plastics trays comprising means for entraining along a plane a thermodeformable strip proceeding through a heating station, a station for forming container cells in the strip, a station for filling with a product the cells and a station for closing the cells with a metal strip comprising wording relative to the nature of the contained product. The heating system consists of mutually overlying heating plates driven intermittently parallel to the feed direction of the thermodeformable strip. The closing station comprises guide means for the metal strip which accompany this latter tangentially above the thermodeformable strip so as to close the container cells. The guide means cooperate with a metal strip stretching device controlled by members for off center detection so as to elongate the strip and center the print on the formed trays.

1 Claim, 3 Drawing Figures

APPARATUS FOR FORMING, FILLING AND CLOSING PLASTICS TRAYS

BACKGROUND OF THE INVENTION

This invention relates to an apparatus for manufacturing thermoformed plastics trays, such as blister packs.

A blister pack essentially comprises a containing part consisting of a thermoplastic film provided with container cells for containing products of various kinds, mainly pharmaceutical products of the pill, tablet, capsule and similar types. The container cells are closed hermetically by a metal foil generally of aluminium fixed over them by thermowelding.

The usual method for manufacturing blister packs comprises heating the thermoplastic web, forming the container cells, filling the container cells with the product and sealing the cells with the metal foil, then separating the individual packs from the resultant strip.

The apparatus used at present are of two types. In the first type, the thermoplastic web is wound on a rotating cylinder comprising a plurality of cellular cavities connected together, and means for exhausting the air, heat being radiated over an arc of the cylinder by suitable lamps. During rotation, the web, which is kept adhering to the cylinder, is drawn into the underlying cavities by the vacuum existing therein so that it assumes their shape, after which it leaves the cylinder to take up a flat position where it is filled. The filling and sealing stages then take place followed by separation of the packs by a cutting operation which results in a piece of reticular scrap from the old strip.

These and similar apparatuses which utilize vacuum for forming are able to operate only with webs of very limited thickness which sometimes due to the drawing process become thin to the point which makes the tightness of the product container cells precarious.

Furthermore, radiant panels of non-uniform heating effect are usually used for heating. Another disadvantage is due to the fact that the container cell walls, being formed about a cylinder, tend to retain the curvature when they pass to a flat position, so producing difficulties during the subsequent cutting and insertion into their packet.

In other apparatus, the web to be formed is fed intermittently while the heating, forming, filling, sealing and cutting operations take place with the web flat during the feed interruption step, which both limits the possibility of correctly placing the product in the container cells and imposes low productivity on the apparatus as a whole.

In other apparatus, although the web is fed intermittently and is heated and formed when flat and at rest, filling takes place with the strip under continuous uniform motion, with a buffer or store being interposed between the forming and filling station to allow temporary accumulation of the web.

In addition, downstream of the filling station there is provided a second buffer or store to enable the web to again pass from continuous movement to the intermittent movement required by the sealing means.

In this case, in addition to a more complicated production line due to the problems of coupling and interdependence between the various working units, the production line length is considerable and its control by the operating personnel is difficult.

A common characteristic of known apparatus is the production of a notable quantity of scrap in the form of reticular strip.

In known apparatus, the presence of intermediate scrap is also to be seen in relation to the need for centering the spacing of the printing reproduced on the covering strip with the effective pitch of the pack. In fact, these apparatuses are based on the principle of keeping the print spacing larger than the pack pitch so as to easily centre the strip, then shrinking to a greater or lesser extent the excess printed strip in the region between one tray and the other, and then removing a suitable strip thereof together with the lateral scrap.

Another method for centering the print consists of providing a theoretical spacing for the print and varying to a greater or lesser degree the distance between one set of impressions and the next. This system is generally used in machines of reciprocating movement driven hydraulically.

SUMMARY OF THE INVENTION

The object of the present invention is to provide an apparatus with which it is possible to control the effectiveness of the heating while preventing damage to the deformable web and enabling strips of different thicknesses and physical characteristics to be formed, and in which the print centering does not lead to the formation of intermediate scrap, so giving rise to considerable economical advantages and simplified collection of the lateral scrap.

This object is attained by an apparatus for manufacturing thermoformed plastic trays, comprising means for entraining along a plane a thermodeformable strip proceeding through a heating station, a station for forming container cells in said strip, a station for filling said container cells and a station for closing the cells with a metal strip comprising wording relative to the nature of the contained product, the wording being spaced apart by a distance slightly less than the longitudinal dimension of the tray, wherein the heating station consists of mutually overlying heating plates driven intermittently parallel to the feed direction of the thermodeformable strip and comprising regions of different degrees of heating and of length substantially equal to the length of forming members rigid with said plates and disposed above and below the thermodeformable strip and driven so that they approach the strip during the forward stroke of the heating plates, and withdraw therefrom during the return stroke, the closing station comprising guide means for the metal strip which accompany this latter tangentially above the thermodeformable strip so as to close the container cells, said means cooperating with a metal strip stretching device controlled by control members so as to elongate the strip and center the print on the formed trays.

BRIEF DESCRIPTION OF THE DRAWINGS

Further details of the invention will be more evident from the description given hereinafter of one embodiment illustrated in the accompanying drawings in which.

DESCRIPTION OF THE PREFERRED EMBODIMENTS

Figure 1:
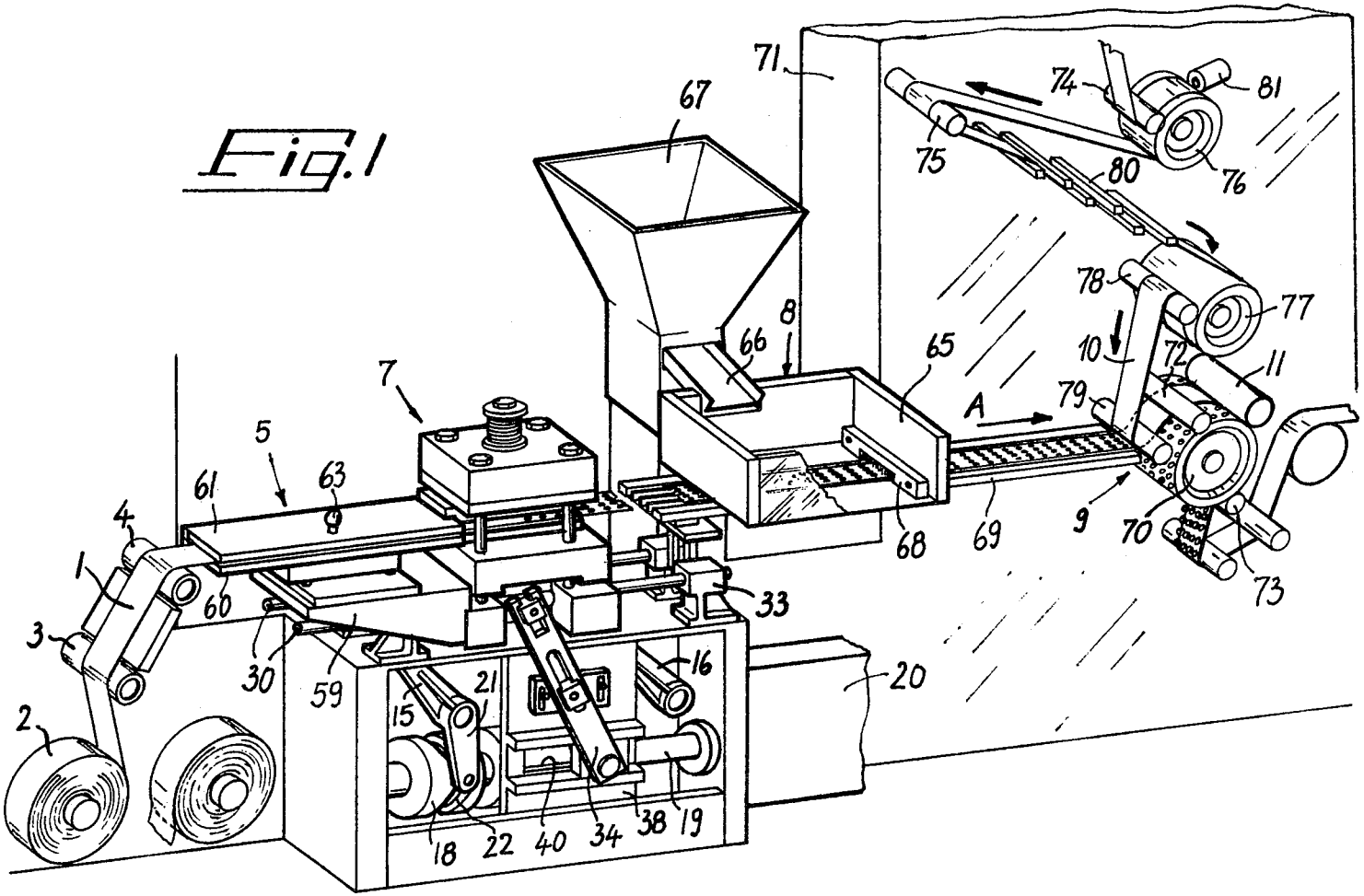
FIG. 1 is a perspective view of the apparatus according to the invention.

With reference to FIG. 1, the reference numeral 1 indicates a strip or web of thermodeformable plastic material which is withdrawn from a spool 2 and engaged by idle rollers, 3, 4, so as to extend in a horizontal plane through a plurality of stations where the various operations are carried out.

The strip 1 thus firstly passes through a heating station 5, where it is raised to a temperature suitable for forming container cells 6 in the subsequent forming station 7. From the forming station 7 the strip provided with cells passes through the filling station 8 in which products, such as tablets, are inserted into the container cells 6. After leaving the station 8, the strip passes through the closing station 9 in which a metal strip 10 is applied so that it closes the container cells already filled with product, and is thermowelded to the strip 1 by the welding roller 11 which produces longitudinal and transverse weld lines.

Figures 2, 3:
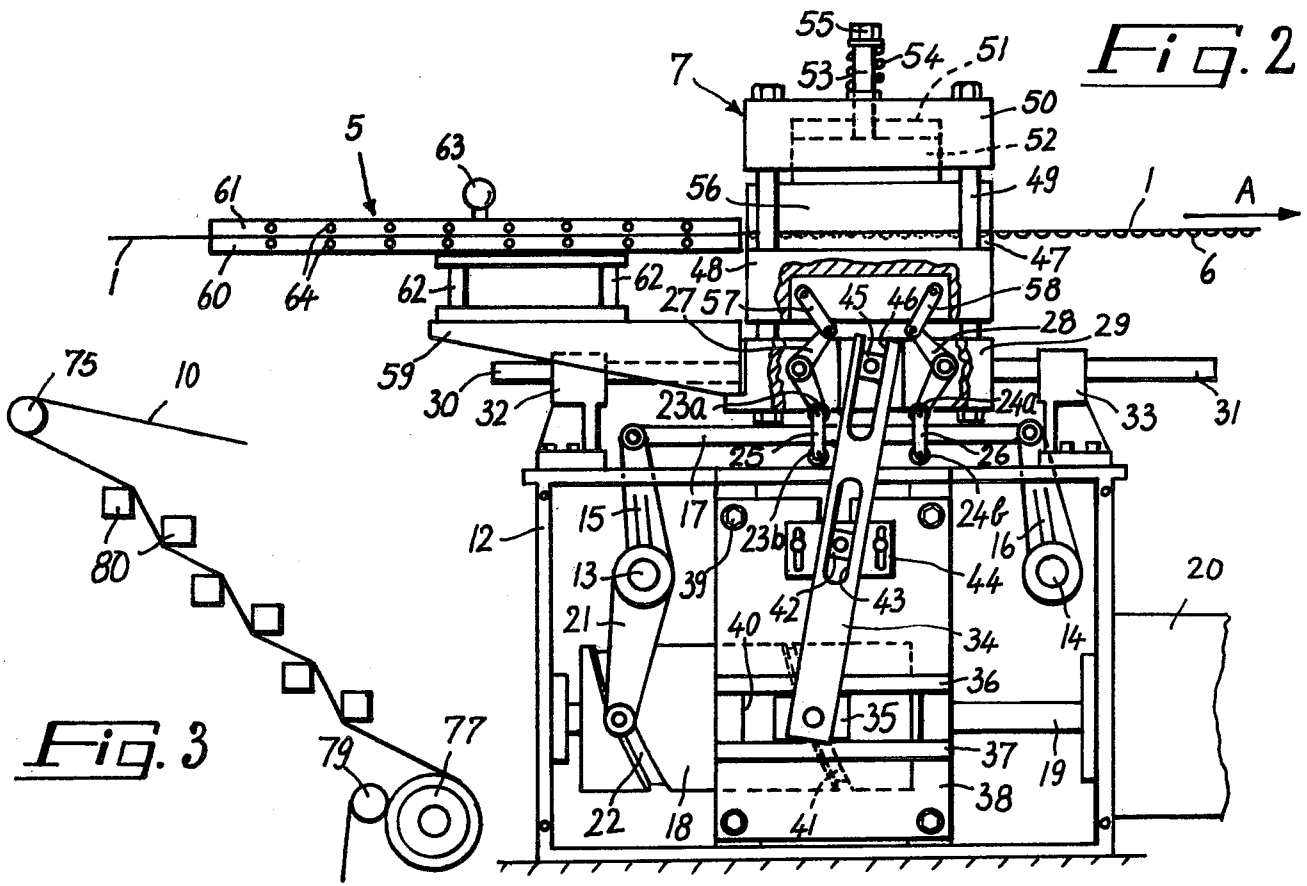
FIG. 2 is a partially diagrammatic section through the heating and forming stations of the apparatus of FIG. 1.
FIG. 3 shows the stretching device.

A cutting station, not shown, trims the longitudinal edges of the welded strips and cuts them along the transverse weld lines, so as to produce individual packs or trays. Normally some indication of the nature of the contained product is required on the packs. Because of imperfections which are always present, the distance or pitch between the printed information on the metal tape never coincides with the longitudinal dimensions of the trays, and thus the distance between the information (hereinafter known as writing wording or print) is made suitably less, even if by a small amount, than the longitudinal dimensions of the trays (i.e. in the direction in which the strip 1 moves), and the exact centering of the print on the corresponding tray is carried out by stretching the metal strip. The stretching device is indicated in FIG. 3 and operates when suitable controls determine that the print has exceeded the allowable off-centre tolerance.

The heating station 5 and the filling station 7 for the strip are both installed on a base 12. Inside the base, fixed pivots 13, 14, rotatably support a pair of parallel arms 15, 16, of equal length, which emerge from the upper surface of the base through slots extending in the direction of swing of the arms 15, 16.

The ends of the arms 15, 16, which project from the upper surface of the base are connected together by a bar 17 so as to form a hinged parallelogram.

The hinged parallelogram is made to swing by an axial cam 18 keyed on to a shaft 19 which is supported horizontally on the sides of the base 12, and driven by a motor 20.

Motion is transmitted from the cam 18 to the parallelogram through a lever 21, one end of which is rigid with the arm 15 and the other end of which carries a roller which slides in an endless groove 22 provided on the axial cam 18.

The bar 17 acts as a slide rail for two pairs of rollers 23*a*, 23*b*, and 24*a*, 24*b*, connected together by links 25, 26, so that the rollers of each pair rotate on the upper and lower edges of the bar 17.

On the same axle as the rollers 23*a*, 24*a*, are hinged the lower arms of angular levers 27, 28, which are centrally pivoted on a prismatic member 29 which forms a slide or carriage which slides horizontally and parallel to the feed direction A of the strip 1. The levers 27, 28 are rotated by the engagement of their lower ends with the bar 17 which is cause to rise or to descend by the oscillation of the arms 15, 16 following the groove 22 of the cam 18.

Two cylindrical parallel rods 30, 31, are fixed in positions corresponding with the opposing ends of the member 29 and are guided in supports 32, 33, mounted on the base 12.

The slide 29 is driven with reciprocating motion by a rocker arm 34 which makes an oscillating movement under the control of the cam 18. For this purpose the lower end of the rocker arm is hinged to a sliding block 35 which is guided between the horizontal guides 36, 37, rigid with a wall 38 fixed by screws 39 to the base. The guides 36, 37, border the top and bottom of an aperture 40 in the wall 38, through which a roller carried by the sliding block 35 engages with the groove 41 in the cam 18. The rocker arm 34 is pivoted in its middle on a small rotatable block 42 which engages in an elongated slot 43 in the rocker arm 34. The small block 42 is hinged on a plate 44 which is adjustable vertically on the wall 38 so as to enable the middle pivot of the rocker arm 34 to be adjusted relative to the point of hinging of the sliding block 35.

The rocker arm 34 is hinged in the slide by a further small rotatable block 45 carried by the slide, and which slides in a slot 46 in the rocker arm 34.

By virtue of the path described by the groove 41 and the position of the middle hinging point 42 of the rocker arm 34, the slide 29 makes reciprocating strokes such that during the advance stroke in the direction A it reaches, and maintains over a certain distance, the constant speed of the strip 1 so that it accompanies this latter, whereas the return stroke occurs at a greater speed to make up the slide acceleration and deceleration times.

The container cells 6 are formed on the strip 1 during the forward stroke by compressed air which deforms the strip inside suitably shaped dies, the strip having previously been heated in station 5. The dies are provided on a plate 47 fixed on a prismatic member 48 which is slidably guided on four columns 49 which rise vertically from the slide 29.

The tops of the columns 49 are connected by a head 50 in which a cylindrical cavity 51 is formed and connected to a source of compressed air, and in which the piston 52 is slidable. The rod 53 of the piston 52 emerges from the top of the head 50, and a compression spring 54 is mounted thereon to act between the head and a backing nut 55 screwed on to the end of the rod 53. The element 56 comprising the channels for conveying the compressed air to deform the strip in the dies is fixed to the piston 52 below the head 50. Although not illustrated, it is apparent that the channels are connected to a source of compressed air, and the outlet of each channel lies above a corresponding die. When compressed air is fed into the cylinder 51, the element 56 is lowered to the level of the strip 1. The dies rise correspondingly to the same level by the rotation of the levers 27, 28, which are connected to the member 48 through linkages 57, 58.

A bracket 59 is mounted on the slide 29, and projects above the rods 30 to carry the heating plates 60, 61, for the strip. The plate 60 is supported by the bracket 59 through columns 62, and the plate 61 is hinged to the plate 60 along its longitudinal side, so that it can be raised by operating a knob 63.

The heating plates have a length substantially equal to double the length of the plate 47. They contain heating elements 64 of a number and power such that half the plates have a heating power different from that of the other half. In particular, the heating power of that half upstream is considerably greater than that half downstream, so that the strip arriving from the spool is firstly subjected to a considerable temperature which enables the heat to reach the most inner layers. In the downstream half, the strip which has already been heated is subjected to a lower temperature representing the optimum forming temperature.

After leaving the forming station 7, the cell-containing strip passes through the filling station 8. The station 8 is of known type and consists substantially of a container 65 into which the products to be inserted into the container cells 6 and originating from a feed hopper 67 are conveyed by means of a chute 66. The container 65 is normally kept full of products and the strip passes through it, sliding on its base, so that the products arrange themselves in the container cells. A scraper 68 holds back excess products, and the strip then slides on the flat surface 69 to reach the closing station 9. The closing station consists of a roller 70 of horizontal axis provided on its periphery with cavities to receive the container cells 6. The roller 70, as are the other rollers indicated hereinafter, is mounted in a cantilever manner on a column 71 of the base and is driven with uniform rotary motion, so that in practice it represents the roller for entraining the strip 1 through the stations 5, 7, 8. The strip 1 is kept adhering to an arc of the surface of the roller 70 by idle rollers 72, 73. The metal strip 10 is applied to the top of the strip 1 along said arc, its purpose being to upperly close the container cells 6. The strip 10 is withdrawn from a spool not shown on the drawing, and winds about a roller 76 through an arc of a circle greater than 180° by being deviated by two idle rollers 74, 75. The strip proceeds from the roller 75 in an oblique path, to engage tangentially with a further roller 77 around which it winds for more than 180° with the aid of a roller 78. The strip 10 then descends from the roller 78 to tangentially join the strip 1 by means of the roller 79. During the path between the rollers 75, 77, the strip 10 is led through a plurality of parallel bars 80 which engage transversely and alternately with the upper and lower surface of the strip. The edges of the bars are arranged so that they engage the strip in such a manner as to cause it to take a zig zag path as shown in FIG. 3.

The bars 80 have the effect of stretching the strip 10, and this effect may be increased or reduced according to requirements by varying the strip tension. The tension and corresponding stretching of the strip are adjusted by braking the roller 76 by a friction clutch which acts on the shaft on which the roller 76 is keyed. The time for which the friction clutch operates is controlled by a sensing device composed of a photoelectric cell 81 which detects the print at the roller 76. To prevent the strip 10 sliding on the roller 77 during braking of the roller 76, holes are suitably provided on the roller 77 and connected to a suction source to keep the strip 10 adhering at its surface.

The operation of the described apparatus may be summarized as follows. During the forward movement of the slide 29, the container cells are formed in the strip 1 which is continuously entrained by the roller 70. The container cells are formed by compressed air after the element 56 has approached the dies, when the slide reaches the speed of the strip 1. In the meantime a portion of the strip approximately equal to one half the length of the plates 60, 61, is raised to the forming temperatures. As the plates have a length double the longitudinal extension of the forming members, that half of the strip heated by the left hand half of the plates during one forward step is heated by the right hand half during the next step. The same portion of the strip is thus subjected to differential heating which leads to more uniform softening of the strip.

When the products have been inserted into the container cells 6, the strip arrives at the closing station. As the photoelectric cell 81 is activated in step with the entraining roller 70, it is also in step with the strip 1 which, because of the engagement of the container cells 6 in the cavities in the roller 70, is rotatably rigid with this latter. If the print on the strip 10 is in the right position for correct application of the packs, the process continues regularly. However when the print begins to anticipate the packs, which occurs because its length is previously made less than the length of the packs, the photoelectric cell 81 emits a signal which by means of suitable logic circuits feeds a command to the friction clutch of the roller 76 which is thus braked, so causing stretching of the strip at the bars 80, the elongation having the effect of retarding the print and bringing it back into step with the packs.

The described apparatus presents considerable advantages. In particular, in addition to effective heating of the strip 1, the forming of the container cells 6 is carried out continuously with the strip flat, and therefore without danger of overall permanent deformation. Moreover, by centering the print by means of stretching the strip, the upper strip is always properly taut and the individual packs may be cut off without producing reticular scrap, and requiring trimming only of the longitudinal edges.

What is claimed is:

1. An apparatus for manufacturing blister packs comprising means for continuously entraining a web of thermodeformable plastic material at a constant speed along a horizontal path, a carriage slidingly supported along said path and parallel thereto, heating means for heating the web consisting of a pair of superimposed plates mounted on said carriage between which the web is led, forming means mounted on said carriage downstream from said heating means for forming product containing cells on said web, means for driving the carriage with reciprocating motion comprising an advance stroke in the web direction during which the carriage reaches and maintains the same speed of the web for a time sufficient to enable the forming means to engage with the latter and to form the cells and a return stroke opposite the web direction after the cells have been formed, a filling station located along said path downstream from said forming means for filling the cells formed in the web, a cell closing station for applying a metal strip over the filled cells, said strip being provided with wordings relative to the nature of the product contained in the cells, said wordings being spaced apart by a distance slightly less than the longitudinal dimension of the packs, means for detecting the position of said wordings with respect to the relative cells and a stretching device controlled by said detecting means so as to cause elongation of the strip when the wordings are in misalignment with the relative cells and to restore alignment of the wordings with the relative cells wherein according to the improvement the stretching device is of the type comprising a plurality of stationary parallel bars having edges transversely and alternately engaging the opposite faces of said metal strip so as to deviate it according to a zig-zag path, a pair of rollers arranged upstream and downstream from said bars on which the metal strip is partially wound and braking means controlled by said detecting means for braking the roller arranged upstream and causing the strip to be put under tension and to elongate by sliding on said bars.

* * * * *